US011532887B2

(12) United States Patent
Yang et al.

(10) Patent No.: US 11,532,887 B2
(45) Date of Patent: Dec. 20, 2022

(54) RADIATION ELEMENT FOR ANTENNA AND ANTENNA INCLUDING THE RADIATION ELEMENT

(71) Applicants: ROSENBERGER TECHNOLOGIES CO., LTD., Suzhou (CN); ROSENBERGER TECHNOLOGIES LLC, Budd Lake, NJ (US)

(72) Inventors: Zhongcao Yang, Suzhou (CN); He Sun, Suzhou (CN)

(73) Assignees: ROSENBERGER TECHNOLOGIES CO., LTD., Suzhou (CN); ROSENBERGER TECHNOLOGIES LLC, Budd Lake, NJ (US)

( * ) Notice: Subject to any disclaimer, the term of this patent is extended or adjusted under 35 U.S.C. 154(b) by 0 days.

(21) Appl. No.: 17/386,993

(22) Filed: Jul. 28, 2021

(65) Prior Publication Data

US 2022/0294116 A1 Sep. 15, 2022

(30) Foreign Application Priority Data

Mar. 15, 2021 (CN) ..... 202110277025.6

(51) Int. Cl.
*H01Q 9/06* (2006.01)
*H01Q 5/335* (2015.01)

(52) U.S. Cl.
CPC ..... *H01Q 9/065* (2013.01); *H01Q 5/335* (2015.01)

(58) Field of Classification Search
CPC .... H01Q 9/065; H01Q 9/285; H01Q 5/30–50; H01Q 21/26
See application file for complete search history.

(56) References Cited

U.S. PATENT DOCUMENTS

| | | | | |
|---|---|---|---|---|
| 10,978,813 | B2 * | 4/2021 | Yang | H01Q 9/285 |
| 2007/0152901 | A1 * | 7/2007 | Hockey | H01Q 21/26 343/793 |
| 2012/0133567 | A1 * | 5/2012 | Harel | H01Q 5/47 343/798 |
| 2012/0218162 | A1 * | 8/2012 | Aoki | H01Q 5/321 343/893 |
| 2013/0069837 | A1 * | 3/2013 | Cozzolino | H01Q 1/521 343/727 |
| 2019/0173186 | A1 * | 6/2019 | Farzaneh | H01Q 21/26 |
| 2020/0067197 | A1 * | 2/2020 | Tang | H01Q 21/062 |
| 2020/0067205 | A1 * | 2/2020 | Segador Alvarez | H01Q 21/26 |

* cited by examiner

*Primary Examiner* — Hasan Islam
(74) *Attorney, Agent, or Firm* — Anova Law Group, PLLC

(57) ABSTRACT

A radiation element for an antenna includes a first pair of dipoles. The first pair of dipoles includes a first dipole and a second dipole, where the first dipole has a first radiation arm and a second radiation arm, and the second dipole has a third radiation arm and a fourth radiation arm. A first connection trace between the first radiation arm of the first dipole and the third radiation arm of the second dipole and a second connection trace between the second radiation arm of the first dipole and the fourth radiation arm of the second dipole are parallel to each other. The radiation arms of the first pair of dipoles are planar structures.

20 Claims, 8 Drawing Sheets

RADIATION ELEMENT FOR ANTENNA AND ANTENNA INCLUDING THE RADIATION ELEMENT

CROSS-REFERENCE TO RELATED APPLICATION

This application claim priority to Chinese Patent Application No. CN 202110277025.6, filed Mar. 15, 2021, the entire content of which is incorporated herein by reference.

TECHNICAL FIELD

The present disclosure relates to the technical field of communication and, more particularly, to a radiation element for antenna, and an antenna having the radiation element.

BACKGROUND

In mobile communication, there are three types of radiation element commonly used in a base station antenna: a microstrip patch radiation element, a symmetric dipole, and a four-point feeding bowl-shaped radiation element.

It is difficult to do impedance match for the microstrip patch radiation element, and working bandwidth of the microstrip patch radiation element is relatively narrow, so it is difficult for the microstrip patch radiation element to meet existing 4G and 4G+ communication requirements for broadband.

Radiation beam of the symmetric dipole is susceptible to interference, and beam stability in broadband range is poor.

Although the existing four-point feeding bowl-shaped radiation element overcomes the disadvantages of the microstrip patch radiation element and the symmetric dipole described above, such a bowl-shaped radiation element is large in volume and material consuming, which makes manufacturing cost of the bowl-shaped radiation element high, and its mounting is relatively inconvenient.

SUMMARY

In accordance with the disclosure, there is provided a radiation element for an antenna including a first pair of dipoles. The first pair of dipoles includes a first dipole and a second dipole, where the first dipole has a first radiation arm and a second radiation arm, and the second dipole has a third radiation arm and a fourth radiation arm. A first connection trace between the first radiation arm of the first dipole and the third radiation arm of the second dipole and a second connection trace between the second radiation arm of the first dipole and the fourth radiation arm of the second dipole are parallel to each other. The radiation arms of the first pair of dipoles are planar structures.

Also in accordance with the disclosure, there is provided an antenna including a radiation element, a radiation element matching circuit, and a reflector. The radiation element has a first pair of dipoles including a first dipole and a second dipole, where the first dipole has a first radiation arm and a second radiation arm, and the second dipole has a third radiation arm and a fourth radiation arm. A first connection trace between the first radiation arm of the first dipole and the third radiation arm of the second dipole and a second connection trace between the second radiation arm of the first dipole and the fourth radiation arm of the second dipole are parallel to each other. The radiation arms of the first pair of dipoles are planar structures.

BRIEF DESCRIPTION OF THE DRAWINGS

The embodiments are shown and described with reference to the drawings. The drawings are used to describe the basic principles, and therefore only show the aspects necessary for understanding the basic principles. The drawings are not to scale. In the drawings, the same reference numerals indicate similar features.

Other features, characteristics, advantages, and benefits of the present disclosure will become more obvious through the following detailed description in conjunction with the accompanying drawings.

DETAILED DESCRIPTION OF THE EMBODIMENTS

In the following detailed description of some embodiments, reference will be made to the accompanying drawings constituting a part of the present disclosure. The accompanying drawings exemplarily illustrate some specific embodiments capable of implementing the present disclosure. The exemplary embodiments are not intended to be exhaustive of all embodiments according to the present disclosure. It can be understood that without departing from the scope of the present disclosure, other embodiments may be used, and structural or logical modifications may also be made. Therefore, the following detailed description is not restrictive, and the scope of the present disclosure is defined by the appended claims.

Advantages and disadvantages of three traditional types of radiation element are described in background. In the present disclosure, inventors creatively thought of designing radiation arms of a traditional bowl-shaped radiation element as a planar structure such as a metal sheet or PCB (printed circuit board). In addition, the traditional bowl-shaped radiation element is optimized through innovation of a connection manner of the radiation arms between different dipoles. On the basis of not enlarging diameter, broadband radiator is achieved through two diagonal dipole arrays, and the radiation characteristics in broadband range are more stable with such a structure. That is, the present disclosure realizes a planar design of the bowl-shaped radiation element, which is more convenient in manufacturing, mounting, and using.

The shape, structure, and connection manner of a planarized radiation element according to the present disclosure, as well as the structure and radiation performance of an antenna including the radiation element, will be respectively introduced below in conjunction with the accompanying drawings.

Figure 1A:
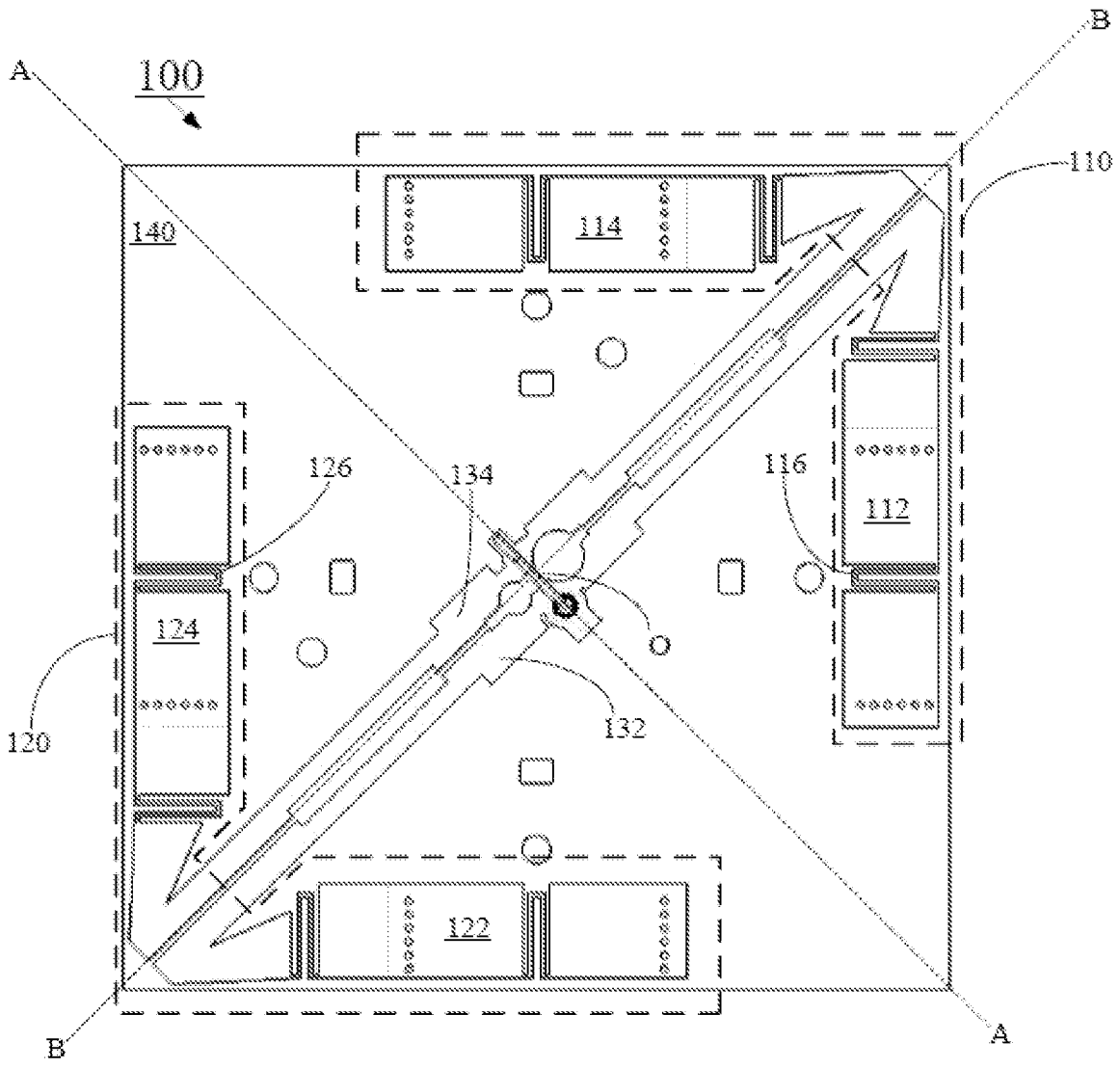
FIG. 1A shows a schematic diagram of a radiation element 100 according to an embodiment of the present disclosure.

FIG. 1A shows a schematic diagram of a radiation element 100 according to an embodiment of the present disclosure. As can be seen from FIG. 1A, the radiation element 100 for an antenna includes a first pair of dipoles. The first pair of dipoles includes a first dipole 110 (indicated by a dashed box in upper right corner) and a second dipole 120 (indicated by a dashed box in lower left corner). The first dipole 110 has a first radiation arm 112 and a second radiation arm 114, and the second dipole 120 has a third radiation arm 122 and a fourth radiation arm 124. A first connection trace 132 between the first radiation arm 112 of the first dipole 110 and the third radiation arm 122 of the second dipole 120 and a second connection trace 134 between the second radiation arm 114 of the first dipole 110 and the fourth radiation arm 124 of the second dipole 120 are parallel to each other. The radiation arms 112, 114, 122, and 124 of the first pair of dipoles 110 and 120 are all planar structures.

In the present disclosure, three-dimensional design of the radiation arms of the traditional bowl-shaped radiation element is replaced by a planar design, which can save materials and reduce manufacturing cost of the radiation element on one hand. On the other hand, with a connection manner of different dipoles, in which the first radiation arm 112 of the first dipole 110 and the third radiation arm 122 of the second dipole 120 are connected by the first connection trace 132, the second radiating arm 114 of the first dipole 110 and the fourth radiation arm 124 of the second dipole 120 are connected by the second connection trace 134, and the first connection trace 132 and the second connection trace 134 are parallel to each other, the design makes impedance matching of the radiation element easier and more accurate, which will directly improve the radiation performance of the radiation element.

As can also be seen from FIG. 1A, each of the multiple radiation arms 112, 114, 122, and 124 described above includes at least two metal sheets, and the at least two metal sheets have a gap in between and are connected to each other by high-impedance metal wires 116 and 126. With a segmented design of the radiation arms 112, 114, 122, and 124 proposed here, and that the different segments are connected to each other by a high-impedance metal wire, the radiation arms 112, 114, 122, and 124 have gaps, which will be beneficial by not causing interference or weaken the interference to the radiation element of another frequency band when the radiation element 100 is integrated with the radiation element of another frequency band, thereby improving anti-interference performance of the radiation element 100 according to the present disclosure when integrated with another radiation element.

Further, as can be seen from FIG. 1A, the first pair of dipoles (the first dipole 110 and the second dipole 120) are symmetric about a first parallel double lines including the first connection trace 132 and the second connection trace 134. In an embodiment according to the present disclosure, in a direction perpendicular to the first parallel double lines, distance of the first parallel double lines at different positions is not always the same. As can be seen in FIG. 1A, vertical distance between the first connection trace 132 and the second connection trace 134 varies with the shape and characteristics of the radiation arms and the size of the radiation element, and it is not always the same, which can achieve the impedance matching. In some embodiments according to the present disclosure, the radiation element can also include a substrate, such as substrate 140 shown in FIG. 1A. In addition, when the radiation element 100 is actually used, the first connection trace 132 is usually coupled to an outer conductor of a coaxial cable, while the second connection trace 134 is coupled to an inner conductor of the coaxial cable.

In addition to the radiating element with the shape described above, i.e., a square design, the present disclosure also proposes radiation elements with other shapes, such as circular, regular octagonal, or other regular polygonal shapes. As can be seen from FIGS. 1A, 1B, and 1C, a common point of these radiation elements is that the radiation element 100 according to the present disclosure includes at least one pair of dipoles 110 and 120, and the radiation arms 112, 114, 122, and 124 of the at least one pair of dipoles are planar structures and are axisymmetric about two mutually perpendicular lines (a symmetry line AA and a symmetry line BB in FIG. 1A), where intersection O of the symmetry line AA and the symmetry line BB that are mutually perpendicular is located at the center of the radiation element 100, that is, the radiation element 100 is central symmetric about the intersection O.

Figure 1B:
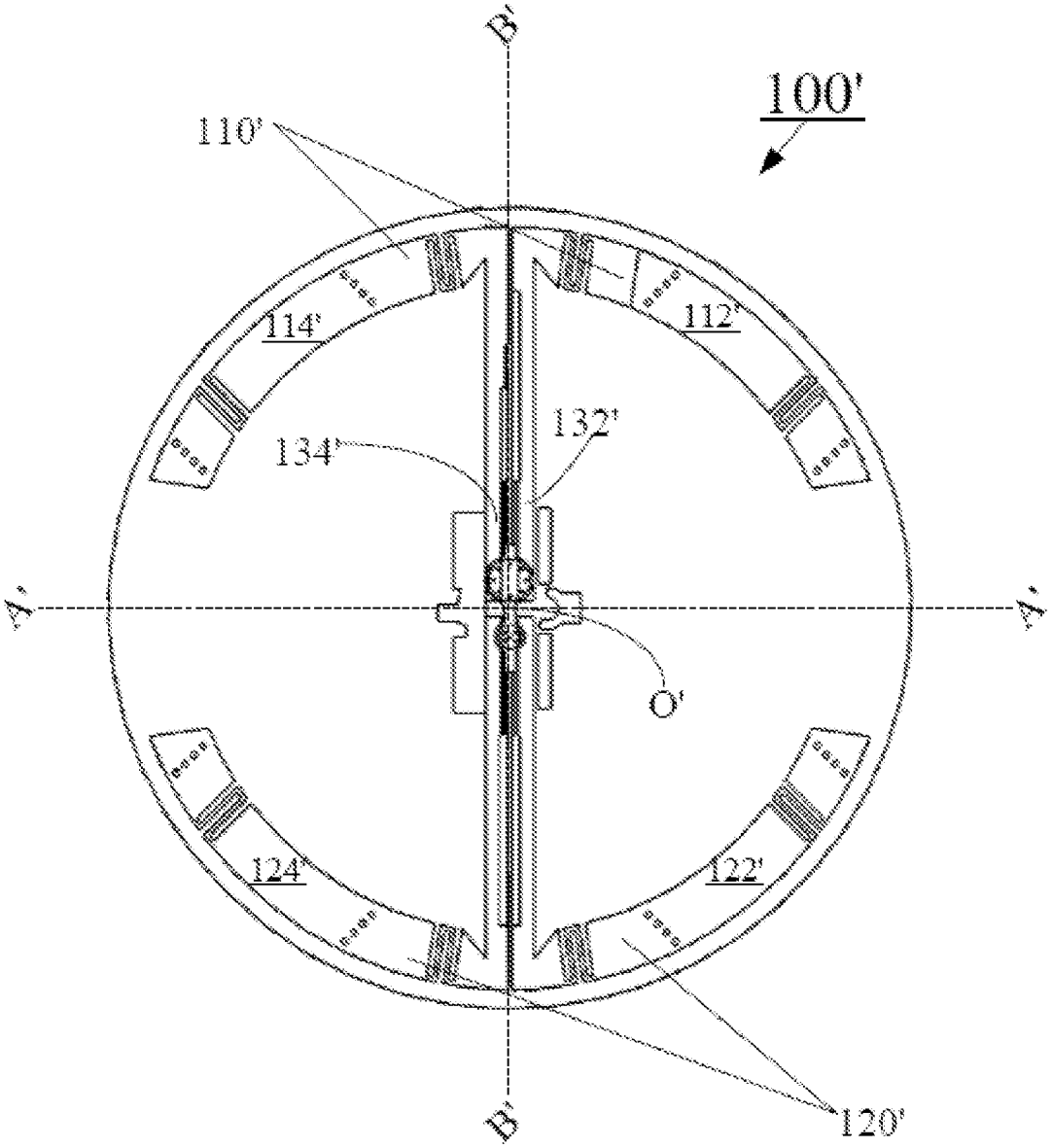
FIG. 1B shows a schematic diagram of a radiation element 100' according to another embodiment of the present disclosure.

FIG. 1B shows a schematic diagram of a radiation element 100' according to another embodiment of the present disclosure. As can be seen from FIG. 1B, the radiation element 100' has a circular-like structure as a whole. Specifically, as can be seen from FIG. 1B, the radiation element 100' according to the present disclosure includes at least one pair of dipoles 110' and 120', and radiation arms 112', 114', 122', and 124' of a first dipole 110' and a second dipole 120' in the at least one pair of dipoles are planar structures and are axisymmetric about two mutually perpendicular lines (a symmetry line A'A' and a symmetry line B'B' in FIG. 1B), where intersection O' of the symmetry line A'A' and the symmetry line B'B' that are mutually perpendicular is located at the center of the radiation element 100', that is, the radiation element 100' is central symmetric about the intersection O'.

Figure 1C:
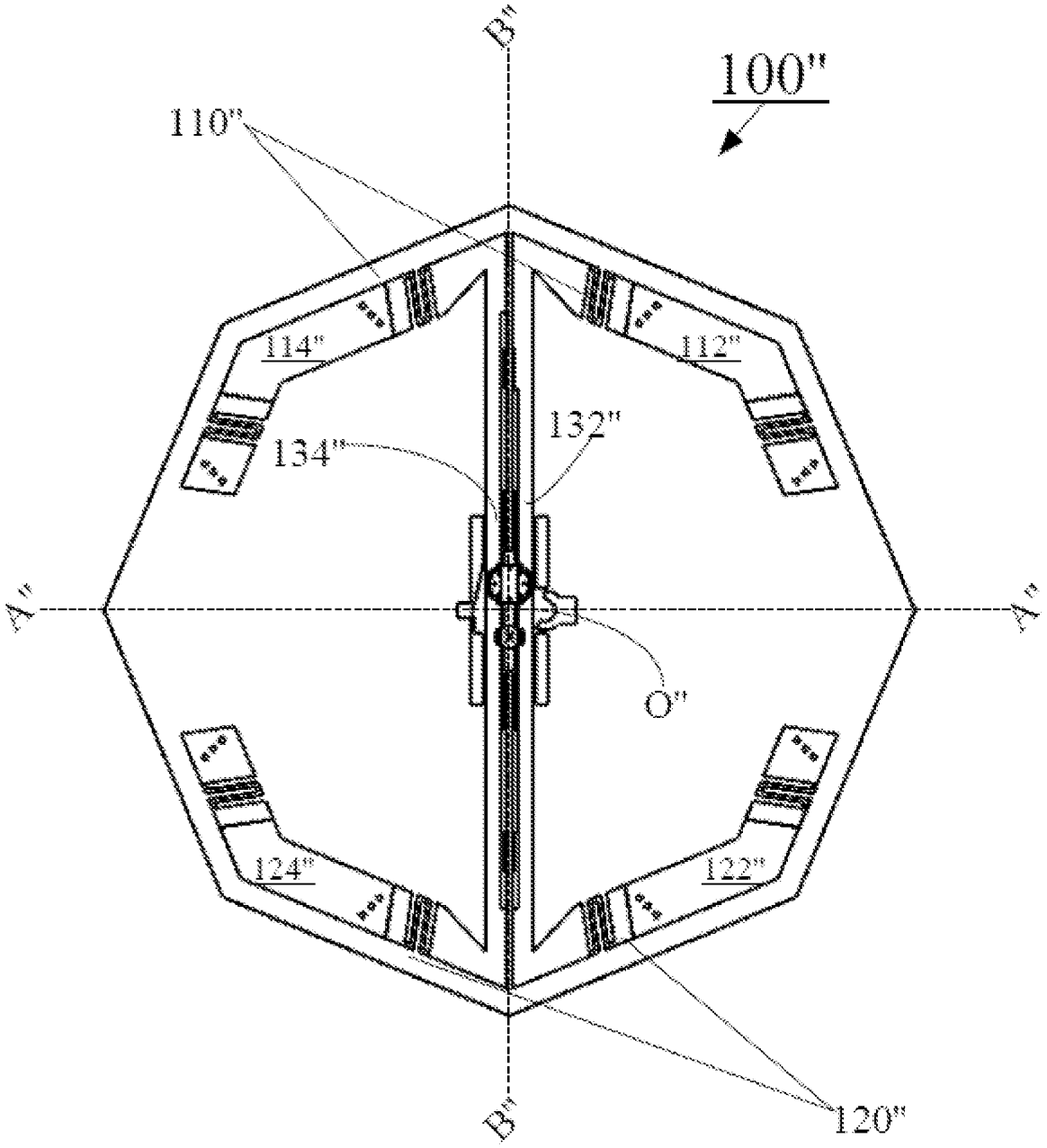
FIG. 1C shows a schematic diagram of a radiation element 100" according to another embodiment of the present disclosure.

FIG. 1C shows a schematic diagram of a radiation element 100" according to another embodiment of the present disclosure. As can be seen from FIG. 1C, the radiation element 100" has a regular-octagon-like structure as a whole. Specifically, as can be seen from FIG. 1C, the radiation element 100" according to the present disclosure includes at least one pair of dipoles 110" and 120", and radiation arms 112", 114", 122", and 124" of a first dipole 110" and a second dipole 120" in the at least one pair of dipoles are planar structures and are axisymmetric about two mutually perpendicular lines (a symmetry line A"A" and a symmetry line B"B" in FIG. 1C), where intersection O" of the symmetry line A"A" and the symmetry line B"B" that are mutually perpendicular is located at the center of the radiation element 100", that is, the radiation element 100" is central symmetric about the intersection O".

Figure 2:
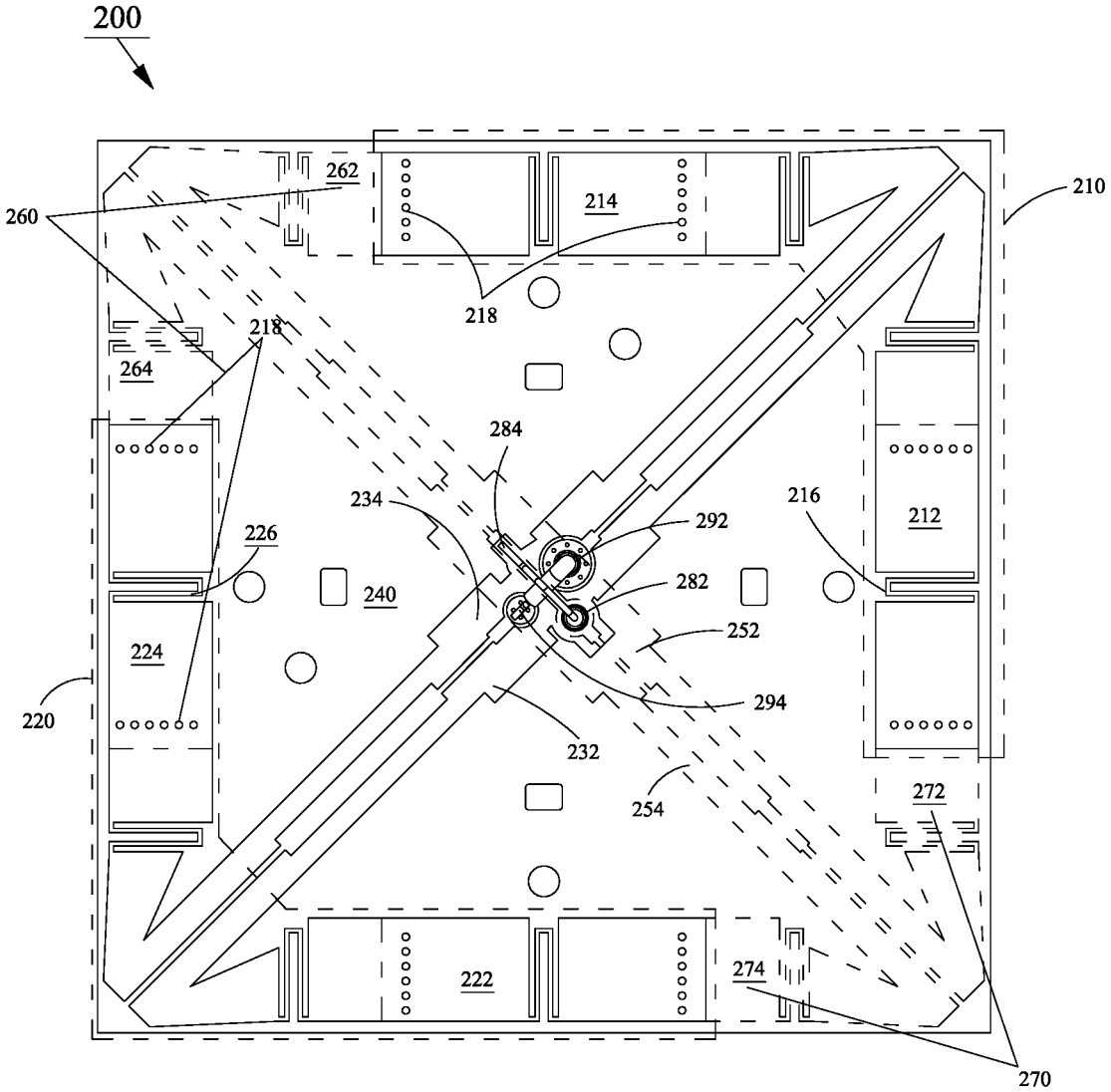
FIG. 2 shows a schematic diagram of a radiation element 200 according to another embodiment of the present disclosure.

The radiation element 100 described above can only radiate one polarity signal. In order to radiate signals of, for example, two polarities, the radiation element can also include another pair of dipoles in this case. FIG. 2 shows a schematic diagram of a radiation element 200 according to another embodiment of the present disclosure.

As can be seen from FIG. 2, the radiation element 200 includes a first pair of dipoles, and the first pair of dipoles includes a first dipole 210 and a second dipole 220. The first dipole 210 has a first radiation arm 212 and a second radiation arm 214, and the second dipole 220 has a third radiation arm 222 and a fourth radiation arm 224. A first connection trace 232 between the first radiation arm 212 of the first dipole 210 and the third radiation arm 222 of the second dipole 220 and a second connection trace 234 between the second radiation arm 214 of the first dipole 210 and the fourth radiation arm 224 of the second dipole 220 are parallel to each other. The radiation arms 212, 214, 222, and 224 of the first pair of dipoles 210 and 220 are all planar structures.

In addition, the radiation element 200 shown in FIG. 2 also includes a second pair of dipoles, and the second pair of dipoles includes a third dipole 260 and a fourth dipole 270. The third dipole 260 has a fifth radiation arm 262 and a sixth radiation arm 264, and the fourth dipole 270 has a seventh radiation arm 272 and an eighth radiation arm 274. A third connection trace 252 between the fifth radiation arm 262 of the third dipole 260 and the seventh radiation arm 272 of the fourth dipole 270 and a fourth connection trace 254 between the sixth radiation arm 264 of the third dipole 260 and the eighth radiation arm 274 of the fourth dipole 270 are parallel to each other. The radiation arms 262, 264, 272, and 274 of the first pair of dipoles 260 and 270 are also planar structures. By arranging another pair of dipoles 260 and 270, the radiation element 200 according to the present disclosure can radiate signals in two polarization directions, such as +45° polarization signals and −45° polarization signals, which thereby expands application scenarios of the radiation element 200 according to the present disclosure. Here, those skilled in the art should understand that the first pair of dipoles and the second pair of dipoles can be arranged in one plane or in different planes.

In addition, as can be seen from the example radiation element 200 shown in FIG. 2, the radiation element 200 also includes a substrate 240, and the radiation arms 212, 214, 222, and 224 of the first dipole 210 and the second dipole 220 in the first pair of dipoles, as well as the radiation arms 262, 264, 272, and 274 of the third dipole 260 and the fourth dipole 270 in the second pair of dipoles are arranged on the substrate 240. In this manner, the radiation arms 212, 214, 222, 224, 262, 264, 272, and 274 of the dipoles are supported by the substrate 240, so that structural stability of the radiation element 200 according to the present disclosure is better and performance stability of the radiation element 200 can be ensured. In some embodiments, the first pair of dipoles 210 and 220 and the second pair of dipoles 260 and 270 are configured to be arranged at two sides of the substrate 240 (e.g., a front/top side and a back/bottom side), respectively. In this manner, usage of substrate area can be maximized, which provides a guarantee for further miniaturization of the radiation element 200 according to the present disclosure. In the solution of arranging dipoles at two sides of the substrate 240, the arrangement of the radiation arms 262, 264, 272, and 274 of the third dipole 260 and the fourth dipole 270 in the second pair of dipoles at the other side (e.g., a back side) is the same as the arrangement of the radiation arms 212, 214, 222, and 224 of the first dipole 210 and the second dipole 220 in the first pair of dipoles at the front side, and the only difference is that a second parallel double lines need to be perpendicular to the first parallel double lines, that is, the second pair of dipoles can be rotated 90 degrees around an axis passing through the center of the substrate 240 and perpendicular to plane of the substrate 240 relative to the first pair of dipoles.

On this basis, in order to further miniaturize the radiation element 200, as can also be seen from FIG. 2, in some embodiments, each of the multiple radiation arms 212, 214, 222, and 224 includes at least one metal sheet. As can be seen from FIG. 2, two metal sheets are connected to form each of the radiation arms 212, 214, 222 and 224. Here, those skilled in the art should understand that the two metal sheets are connected to form each of the radiation arms 212, 214, 222, and 224 are only exemplary rather than restrictive. For example, it is also possible that one metal sheet or three metal sheets form each of the radiation arms 212, 214, 222, and 224.

In addition, as can also be seen from FIG. 2, for example, the at least one metal sheet of the radiation arms 212, 214, 222, and 224 has metallized via holes 218 and 228, which penetrate the substrate 240 and electrically couple In some embodiments, the radiation arms 272, 262, 274, and 264, which respectively correspond to the radiation arms 212, 214, 222, and 224, may have at least one metal sheet additionally provided at the other side of the substrate 240. The metallized via holes 218 are configured to electrically connect at least one metal sheet of a radiation arm disposed on one side of the substrate 240 with at least one metal sheet of a radiation arm disposed at a corresponding location on the other side of the substrate 240. In one embodiment, a metal sheet of the radiation arm 224 is electrically connected to a metal sheet of the radiation arm 264 through the metalized via holes 218. In one embodiment, a metal sheet of the radiation arm 214 is electrically connected to a metal sheet of the radiation arm 262 through the metalized via holes 218. By this design of the metallized via holes 218, the radiation arms arranged at either side of the substrate 240 (such as the radiation arms 212, 214, 222, and 224, and the radiation arms 272, 262, 274, and 264) can be extended, so as to ensure that the radiation element 200 according to the present disclosure can be further miniaturized. In addition, the metallized via holes 218 can conduct the radiation arms at two sides of the substrate, and reduce the influence of change in dielectric constant of the substrate such as a printed circuit board PCB, which allows a wider selection of the substrate such as the printed circuit boards PCB.

As can also be seen from FIG. 2, each of the multiple radiation arms 212, 214, 222, and 224 described above respectively includes at least two metal sheets, and the at least two metal sheets have a gap in between and are connected to each other by high-impedance metal wires 216 and 226. With a segmented design of the radiation arms 212, 214, 222, and 224 proposed here, and that the different segments are connected to each other by a high-impedance metal wires, the radiation arms 212, 214, 222, and 224 have gaps, which will be beneficial by not causing interference or weaken the interference to the radiation element of another frequency band when the radiation element 200 is integrated with the radiation element of another frequency band, thereby improving anti-interference performance of the radiation element 200 according to the present disclosure when integrated with another radiation element. Similarly, the corresponding radiation arms 272, 262, 274, and 264 arranged at the other side of the substrate 240 also have the same design.

In addition, as can be seen from FIG. 2, an outer conductor 282 of a coaxial cable is, for example, electrically connected to the first connection trace 232, and an inner conductor 284 is, for example, electrically connected to the second connection trace 234; correspondingly, an outer conductor 292 of another coaxial cable is, for example, electrically coupled to the third connecting trace 252, and an inner conductor 294 is, for example, electrically coupled to the fourth connecting trace 254.

The above only describes the structure of the radiation element and the connection manner of the radiation element with, for example, the coaxial cable. The connection manner of an antenna including the radiation element described above, as well as implementation form of the antenna with the radiation element described above will be described below in conjunction with FIGS. 3-6. In a nutshell, the antenna may include the radiation element described above, a radiation element matching circuit, and a reflector. The radiation element matching circuit includes at least one impedance matching device, which is connected between the reflector and the radiation element and is electrically connected to at least the radiation arms of the first pair of dipoles of the radiation element.

Figure 3:
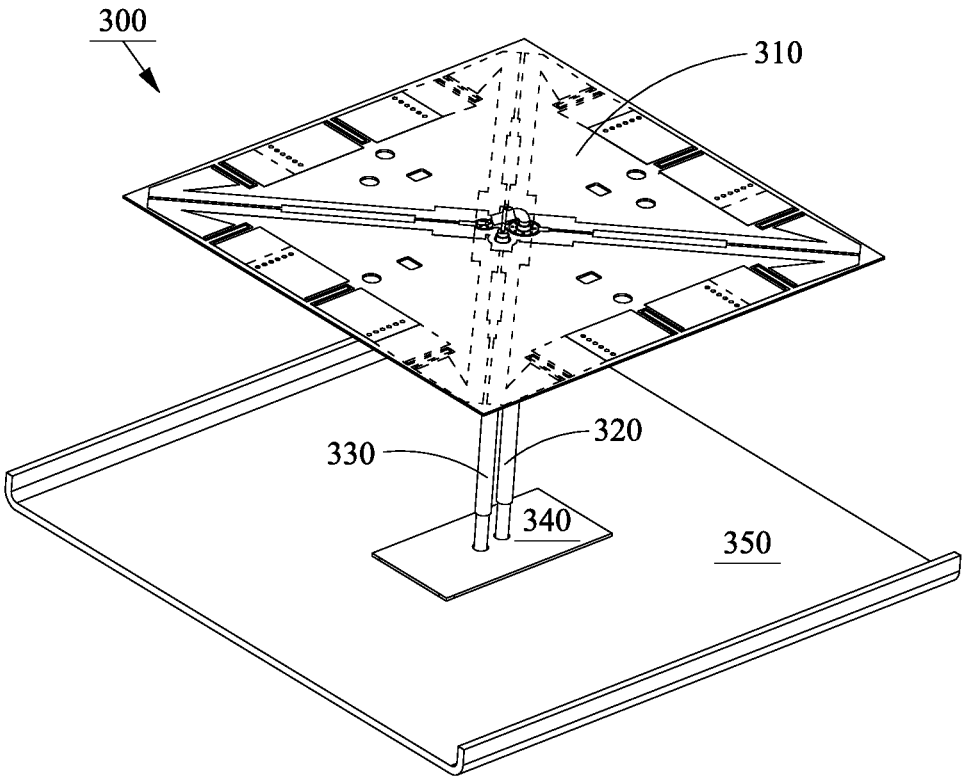
FIG. 3 shows an oblique top perspective view of an antenna 300 including a radiation element according to an embodiment of the present disclosure.
Figure 4:
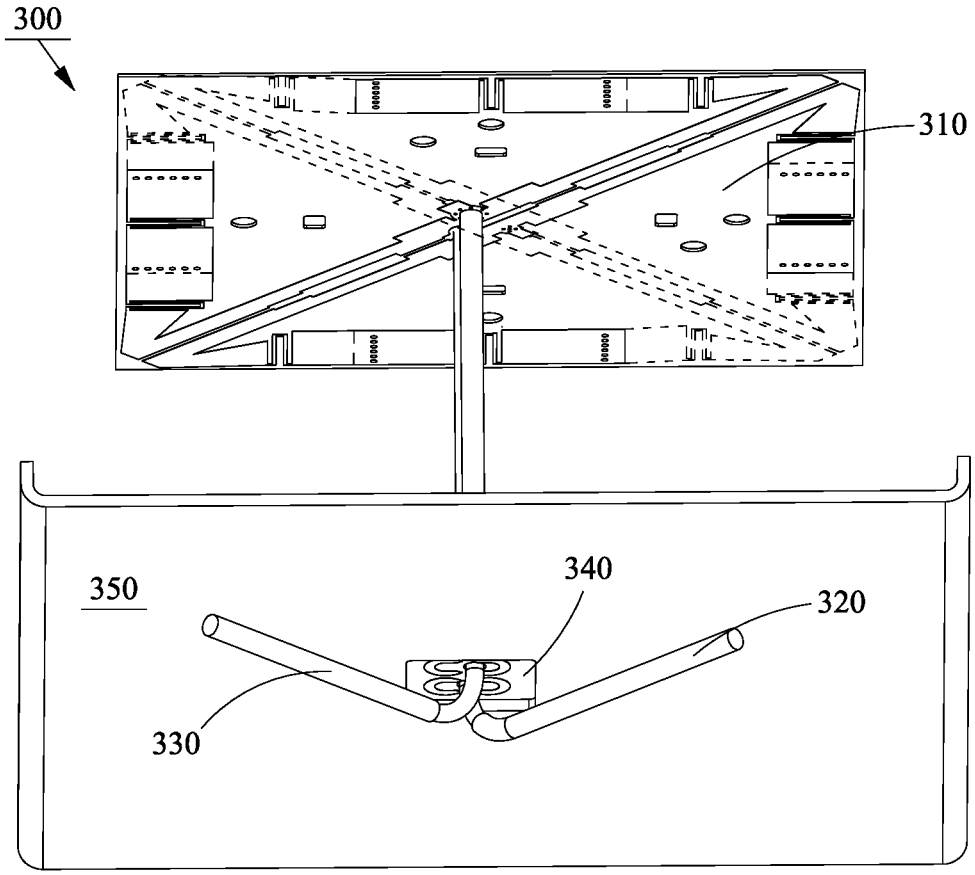
FIG. 4. shows an oblique bottom perspective view of an antenna 300 including a radiation element according to an embodiment of the present disclosure.

FIG. 3 shows an oblique top perspective view of an antenna 300 including the radiation element according to the present disclosure, and FIG. 4 shows an oblique bottom perspective view of the antenna 300 including the radiation element according to the present disclosure. As can be seen from FIGS. 3 and 4, the antenna 300 according to the present disclosure includes a radiation element 310 described above, a radiation element matching circuit, and a reflector 350. In addition, in the example antenna 300 shown in FIGS. 3 and 4, the radiation element matching circuit includes at least one impedance matching device, and the at least one impedance matching device includes coaxial cables 320, 330, and a printed circuit board 340. Outer conductors of the coaxial cables 320 and 330 are electrically coupled to the reflector 350 via the printed circuit board 340, and the two coaxial cables 320 and 330 are connected between the radiation element 310 and the reflector 350. Here, those skilled in the art should understand that the two coaxial cables 320 and 330 here are only exemplary rather than restrictive. If the radiation element 310 only needs to radiate signals in one polarity direction, only one coaxial cable is required. Correspondingly, if the radiation element 310 needs to radiate signals in three or more polarity directions, three or more coaxial cables are required. In addition to the device described above, as can be seen from FIGS. 3 and 4, the outer conductor of the first coaxial cable 320 is, for example, electrically coupled to the first connection trace, and the inner conductor of the first coaxial cable 320 is, for example, electrically coupled to the second connection trace; correspondingly, the outer conductor of the second coaxial cable 330 is, for example, electrically coupled to the third connection trace, and the inner conductor of the second coaxial cable 330 is, for example, electrically coupled to the fourth connection trace. At parts of the coaxial cables far away from the connection with the radiation element 310, as described above, the outer conductors of the coaxial cables 320 and 330 are electrically coupled to the reflector 350 via the printed circuit board 340, thereby realizing effective coupling and grounding of the outer conductors of the coaxial cables. Here, the two coaxial cables 320 and 330 can be, for example, connected to a middle position of the reflector 350 via the printed circuit board 340, and pass through the reflector 350 from the middle position.

Figure 5:
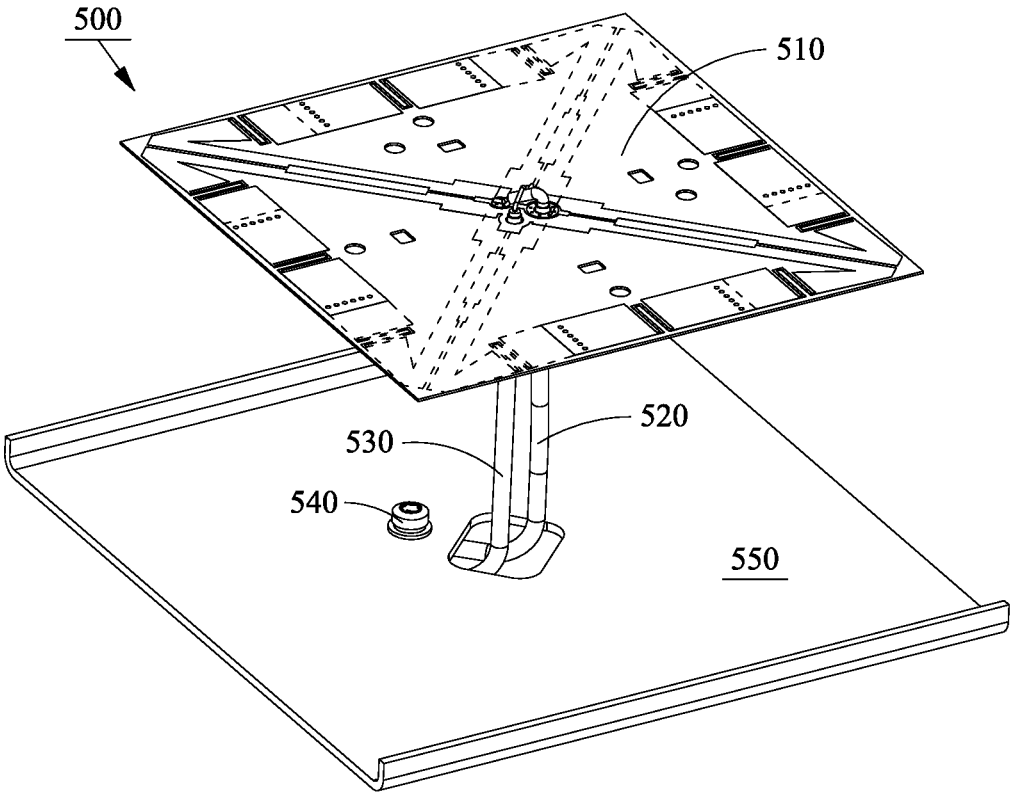
FIG. 5. shows an oblique top perspective view of an antenna 500 including a radiation element according to an embodiment of the present disclosure.
Figure 6:
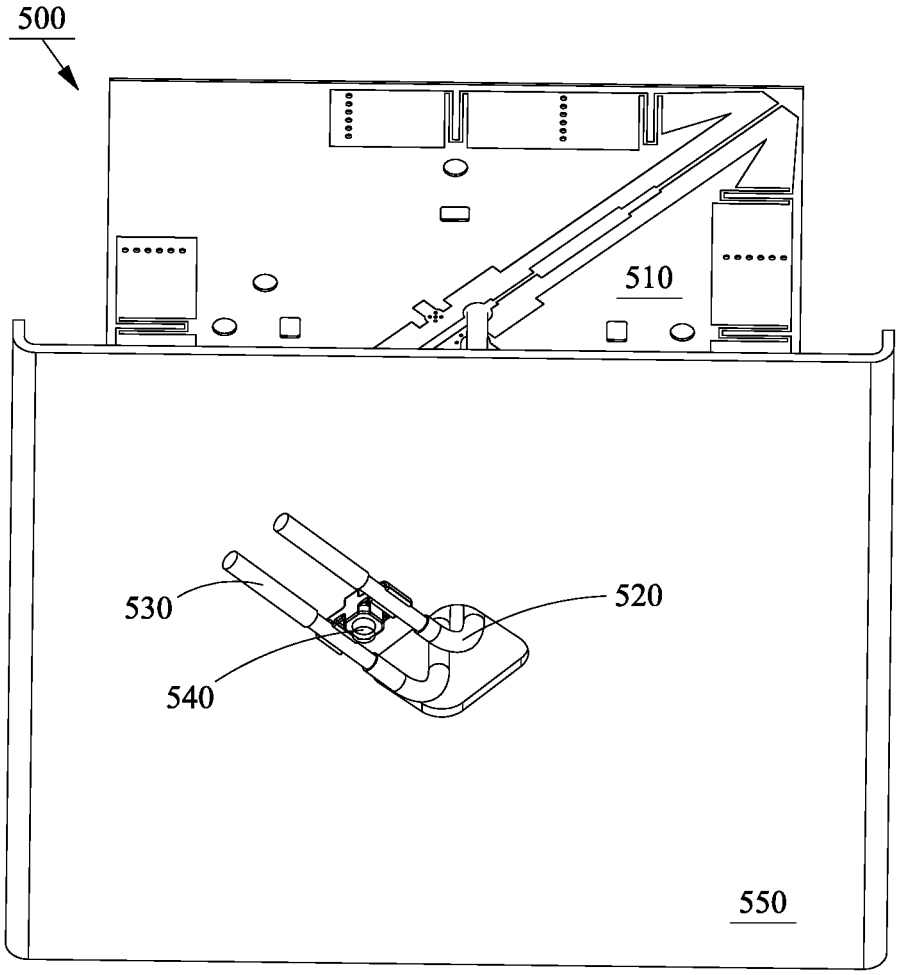
FIG. 6. shows an oblique bottom perspective view of an antenna 500 including a radiation element according to an embodiment of the present disclosure.

FIGS. 5 and 6 show another grounding mode. FIG. 5 shows an oblique top perspective view of an antenna 500 including the radiation element according to the present disclosure, and FIG. 6 shows an oblique bottom perspective view of the antenna 500 including the radiation element according to the present disclosure. As can be seen from FIGS. 5 and 6, the antenna 500 according to the present disclosure includes a radiation element 510 described above, a radiation element matching circuit, and a reflector 550. In addition, in the example antenna 500 shown in FIGS. 5 and 6, the radiation element matching circuit includes at least one impedance matching device, and the at least one impedance matching device includes coaxial cables 520, 530, and a conductive connection block 540. Outer conductors of the coaxial cables 520 and 530 are electrically coupled to the reflector 550 via the conductive connection block 540, and the two coaxial cables 520 and 530 are connected between the radiation element 510 and the reflector 550. Here, those skilled in the art should understand that the two coaxial cables 520 and 530 here are only exemplary rather than restrictive. If the radiation element 510 only needs to radiate signals in one polarity direction, only one coaxial cable is required. Correspondingly, if the radiation element 510 needs to radiate signals in three or more polarity directions, three or more coaxial cables are required. In addition to the device described above, as can be seen from FIGS. 5 and 6, the outer conductor of the first coaxial cable 520 is, for example, electrically coupled to the first connection trace, and the inner conductor of the first coaxial cable 520 is, for example, electrically coupled to the second connection trace; correspondingly, the outer conductor of the second coaxial cable 530 is, for example, electrically coupled to the third connection trace, and the inner conductor of the second coaxial cable 530 is, for example, electrically coupled to the fourth connection trace. In the embodiment of the exemplary antenna 500 shown in FIGS. 5 and 6 according to the present disclosure, as described above, the at least one impedance matching device includes the coaxial cables 520, 530 and the conductive connection block 540. The outer conductors of the coaxial cables 520 and 530 are electrically coupled to the reflector 550 via the conductive connection block 540, thereby realizing direct current grounding of the outer conductors of the coaxial cables 520 and 530. Here, the conductive connecting block 540 is, for example, a metal stopper including two buckling positions, as well as screws and nuts. The conductive connection block 540 can be electrically coupled to the outer conductors of the coaxial cables 520 and 530 with the two buckling positions, and then electrically coupled to the reflector 550 with the screws and nuts, thereby realizing the direct current grounding of the outer conductors of the coaxial cables 520 and 530. Here, the two coaxial cables 520 and 530 can be, for example, connected to a middle position of the reflector 550 via the conductive connection block 540, and pass through the reflector 550 from the middle position.

In addition to the two implementation manners described above, the present disclosure also proposes another implementation manner with a printed circuit board PCB and a balun, that is, a printed circuit board PCB and a balun are used to form a radiation element matching circuit. The balun includes microstrip lines, and the balun is electrically coupled to the reflector via the printed circuit board. In this implementation manner, the balun is used to replace the coaxial cable, and its working principle is equivalent to replacing the coaxial cable with a 50-ohm microstrip line plus a section of coaxial cable between the radiation element and the coupled printed circuit board PCB in the coupled printed circuit board PCB feeding mode, which can also achieve feeding. Generally speaking, in an embodiment according to the present disclosure, the at least one impedance matching device includes a balun and a printed circuit board. The balun includes microstrip lines, and the balun is electrically coupled to the reflector via the printed circuit board.

In summary, with the features described above, three-dimensional design of the radiation arms of the traditional bowl-shaped radiation element is replaced by a planar design, which can save materials and reduce manufacturing cost of the radiation element on one hand. On the other hand, with a connection manner of different dipoles, the design makes impedance matching of the radiation element easier and more accurate, which will directly improve the radiation performance of the radiation element.

Although different exemplary embodiments of the present disclosure have been described, it is obvious to those skilled in the art that various changes and modifications can be made, which can realize one or some of the advantages of the present disclosure without departing from the spirit and scope of the present disclosure. For those skilled in the art, other components performing the same function can be replaced as appropriate. It should be understood that the features explained herein with reference to a particular figure can be combined with features of other figures, even in those cases where this is not explicitly mentioned. In addition, the method of the present disclosure can be implemented either in all software implementations using appropriate processor instructions or in a hybrid implementation using a combination of hardware logic and software logic to achieve the same result. Such modifications to the solution according to the present disclosure are intended to be covered by the appended claims.

What is claimed is:

1. A radiation element for an antenna comprising:

a first pair of dipoles configured to radiate signals in at least one polarization direction, the first pair of dipoles comprising:

a first dipole having a first radiation arm and a second radiation arm; and a second dipole having a third radiation arm and a fourth radiation arm;

wherein:

the first dipole and the second dipole are disposed opposed to each other on a substrate and symmetrical to a center line of the substrate;

a part of a first connection trace that connects the first radiation arm of the first dipole with the third radiation arm of the second dipole and a part of a second connection trace that connects the second radiation arm of the first dipole with the fourth radiation arm of the second dipole are parallel to each other;

the radiation arms of the first pair of dipoles are planar structures; and the first connection trace and the second connection trace are located on a same plane of the substrate as the radiation arms of the first pair of dipoles.

2. The radiation element of claim 1, further comprising a second pair of dipoles comprising:

a third dipole having a fifth radiation arm and a sixth radiation arm; and a fourth dipole having a seventh radiation arm and an eighth radiation arm;

wherein:

a third connection trace between the fifth radiation arm of the third dipole and the seventh radiation arm of the fourth dipole and a fourth connection trace between the sixth radiation arm of the third dipole and the eighth radiation arm of the fourth dipole are parallel to each other; and the radiation arms of the second pair of dipoles are also planar structures.

3. The radiation element of claim 2, wherein the substrate that hosts the radiation arms of the first pair of dipoles also hosts the radiation arms of the second pair of dipoles.

4. The radiation element of claim 3, wherein the radiation arms of the first pair of dipoles are arranged at a first side of the substrate, and the radiation arms of the second pair of dipoles are arranged at a second side of the substrate.

5. The radiation element of claim 4, wherein each of the radiation arms comprises at least one metal sheet having at least one metallized via hole, the metallized via hole penetrating the substrate and electrically connecting the at least one metal sheet at one side of the substrate with a metal sheet provided at the opposite side of the substrate.

6. The radiation element of claim 1, wherein the first pair of dipoles is symmetric along a first parallel double lines, the first parallel double lines comprising the first connection trace and the second connection trace.

7. The radiation element of claim 6, wherein a distance between the first parallel double lines at a first position is not the same as a distance between the first parallel double lines at a second position, the distance being in a direction perpendicular to the first parallel double lines.

8. The radiation element of claim 1, wherein each of the radiation arms comprises at least two metal sheets having a gap in between and being connected to each other by a high-impedance metal wire.

9. An antenna comprising:

a radiation element having a first pair of dipoles configured to radiate signals in at least one polarization direction, the first pair of dipoles comprising:

a first dipole having a first radiation arm and a second radiation arm; and a second dipole having a third radiation arm and a fourth radiation arm;

wherein:

the first dipole and the second dipole are disposed opposed to each other on a substrate and symmetrical to a center line of the substrate;

a part of a first connection trace that connects the first radiation arm of the first dipole with the third radiation arm of the second dipole and a part of a second connection trace that connects the second radiation arm of the first dipole with the fourth radiation arm of the second dipole are parallel to each other;

the radiation arms of the first pair of dipoles are planar structures; and the first connection trace and the second connection trace are located on a same plane of the substrate as the radiation arms of the first pair of dipoles, a matching circuit for the radiation element; and a reflector.

10. The antenna of claim 9, wherein the radiation element matching circuit comprises at least one impedance matching device, the at least one impedance matching device being connected between the reflector and the radiation element and being electrically connected to at least the radiation arms of the first pair of dipoles of the radiation element.

11. The antenna of claim 10, wherein the at least one impedance matching device comprises a coaxial cable and a printed circuit board, an outer conductor of the coaxial cable is electrically connected to the reflector via the printed circuit board.

12. The antenna of claim 10, wherein the at least one impedance matching device comprises a coaxial cable and a conductive connection block, an outer conductor of the coaxial cable is electrically connected to the reflector via the conductive connection block.

13. The antenna of claim 10, wherein the at least one impedance matching device comprises a balun and a printed circuit board, the balun comprising a microstrip line and being electrically connected to the reflector via the printed circuit board.

14. The antenna of claim 9, wherein the radiation element further comprises a second pair of dipoles comprising:

a third dipole having a fifth radiation arm and a sixth radiation arm; and a fourth dipole having a seventh radiation arm and an eighth radiation arm;

wherein:

a third connection trace between the fifth radiation arm of the third dipole and the seventh radiation arm of the fourth dipole and a fourth connection trace between the sixth radiation arm of the third dipole and the eighth radiation arm of the fourth dipole are parallel to each other; and the radiation arms of the second pair of dipoles are also planar structures.

15. The antenna of claim 14, wherein the substrate that hosts the radiation arms of the first pair of dipoles also hosts the radiation arms of the second pair of dipoles.

16. The antenna of claim 15, wherein the radiation arms of the first pair of dipoles are arranged at a first side of the substrate, and the radiation arms of the second pair of dipoles are arranged at a second side of the substrate.

17. The antenna of claim 16, wherein each of the radiation arms comprises at least one metal sheet having at least one metallized via hole, the metallized via hole penetrating the substrate and electrically connecting the at least one metal sheet at one side of the substrate with a metal sheet provided at the opposite side of the substrate.

18. The antenna of claim 9, wherein the first pair of dipoles is symmetric along a first parallel double lines, the first parallel double lines comprising the first connection trace and the second connection trace.

19. The antenna of claim 18, wherein a distance between the first parallel double lines at a first position is not the same as a distance between the first parallel double lines at a second position, the distance being in a direction perpendicular to the first parallel double lines.

20. The antenna of claim 9, wherein each of the radiation arms comprises at least two metal sheets having a gap in between and being connected to each other by a high-impedance metal wire.

* * * * *